United States Patent [19]

Orentreich et al.

[11] 4,044,889

[45] Aug. 30, 1977

[54] COSMETIC CONTAINER INCLUDING INTEGRATED LENS STRUCTURE

[76] Inventors: Seymour Orentreich, 99 Greenway Terrace, Forest Hills, N.Y. 11375; Joseph Vogelman, 48 Green Drive, Roslyn, N.Y. 11576

[21] Appl. No.: 722,527

[22] Filed: Sept. 13, 1976

[51] Int. Cl.[2] ..... B65D 25/54; G02C 11/02

[52] U.S. Cl. ..... 206/459; 206/38; 220/82 A; 350/243

[58] Field of Search ..... 206/459, 37, 38, 45, 206/34; 220/82 A; 350/114, 115, 242, 243

[56] References Cited

U.S. PATENT DOCUMENTS

| | | | |
|---|---|---|---|
| 210,274 | 11/1878 | Stohlmann | 350/115 |
| 2,961,108 | 11/1960 | Johnson | 220/82 A |
| 3,052,158 | 9/1962 | Sonni | 220/82 A |
| 3,080,964 | 3/1963 | Robinson et al. | 220/82 A |
| 3,409,347 | 11/1968 | Vogel | 350/242 |

FOREIGN PATENT DOCUMENTS

| | | | |
|---|---|---|---|
| 845,561 | 8/1960 | United Kingdom | 206/45.34 |

*Primary Examiner*—William T. Dixson, Jr.
*Attorney, Agent, or Firm*—Hopgood, Calimafde, Kalil, Blaustein & Lieberman

[57] ABSTRACT

A cosmetic container includes one member on which a listing of the ingredients of the material contained is printed in letters which are too small to be read without magnification. An overlying member of the container includes a Fresnel lens structure, which, when the container is in a closed condition, overlies and is in registration with the ingredient-identifying small print on the other member to magnify and make readable the small print.

2 Claims, 6 Drawing Figures

COSMETIC CONTAINER INCLUDING INTEGRATED LENS STRUCTURE

The present invention relates generally to containers, and more specifically to a container, such as a cosmetic container, on which a listing of ingredients of the contents is printed:

The aesthetic appearance of containers of certain products is of considerable importance in the sales appeal of those products, and may actually be a greater factor in the appeal of the product to the customer than the quality of the product in the container.

Cosmetics are among those products for which the aesthetic appearance of the container plays a major role in the sale of the product. For this reason, manufacturers of cosmetic products, such as lipsticks and powders, expend considerable effort in an attempt to package their products in highly visually appealing and decorative containers.

In recent years, federal regulations have been promulgated which require that the ingredients of certain cosmetic items, such as lipstick, be printed on the container in which these products are sold in such a manner that they can be read by the consumer. This requirement has presented the cosmetic manufacturer with several problems, the solutions to which are often mutually contradictory. One problem is that there is usually little space available on the container on which to print the ingredient information in a size of lettering that can be easily read. Another problem is that printing this information in readable-size type on the container detracts from the aesthetic appearance of the container.

The incorporation of a conventional lens into the container to magnify the ingredient information printed on the container in a reduced-size lettering would be impractical and difficult. Moreover, such a lens would add to the bulk of the container because of the thickness and shape of the lens, and would detract from the aesthetic appearance of the container, which in the context of cosmetic containers, would seriously adversely affect the commercial appeal of the product.

It is, therefore, a general object of the invention to provide a container of the type particularly suited for cosmetic items, in which the ingredient information printed thereon may be read by the consumer without materially detracting from the aesthetic appearance of the container.

It is a more specific object of the invention to provide a container for cosmetic items in which a magnifying element is incorporated into the container in a manner which enhances, rather than detracts from, the appearance of the container.

To these ends, the container of the invention includes a first member on which the ingredient information is printed in letters that are too small to be read by the naked eye, and a second member in which a Fresnel lens is incorporated. When the container is in a closed condition, that is, not in use, the second member overlies the first member in such a manner that the Fresnel lens is in substantial registration with the small-size ingredient data. In this position of the container, the Fresnel lens magnifies the ingredient information to enable the consumer to easily read this information. The Fresnel lens is so incorporated into the container as to enhance, rather than detract from, its visual appearance.

To the accomplishment of the above and other objects as may hereinafter appear, the present invention relates to a container substantially as defined in the appended claims and as described in the following detailed specification as considered with the accompanying drawings in which:

Figure 1:
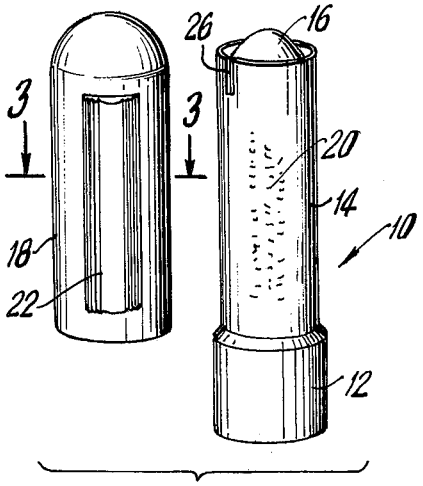
FIG. 1 is an exploded view of a cosmetic container in accordance with the present invention as embodied in a lipstick container showing the cover removed from the tube.
Figure 2:
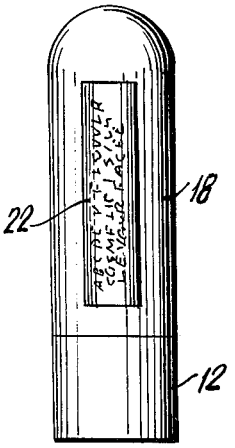
FIG. 2 is an elevation of the cosmetic container of the invention shown in the closed or nonuse position.
Figure 3:
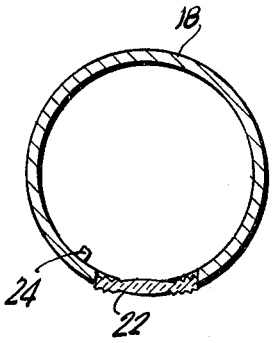
FIG. 3 is a cross-sectional diagram of the cover taken across the lines 3—3 of FIG. 1.

The embodiment of the invention illustrated in FIGS. 1-3 is a lipstick container which comprises a cylindrical tube 10 having a lower base 12 and a reduced diameter cylinder 14 open at its upper end and containing a stick of lipstick 16, the tip of which extends from the opening of cylinder 14. As is conventional, the rotation of base 12 causes the lipstick to axially move out of and into the interior of cylinder 14. The container further includes a decorative cover 18, which when the container is closed or not in use, is placed over the tube 10 to protect the lipstick, as shown in FIG. 2.

The ingredients of the product in the container, here the lipstick, must be listed on the container in readable form. In the container of the invention, the list of ingredients is printed on cylinder 14 in small print as indicated as 20 in FIG. 1, which to the naked eye, that is, without magnification, is not readable. To enable the consumer to readily read these ingredients before she purchases the product, the container cover 18 has formed therein a thin Fresnel lens 22, which when the cover is placed over the tube, as in FIG. 2, overlies and is in registration with the small print ingredient information on cylinder 14 so as to magnify that printing and render it readable by the consumer, as is also shown in FIG. 2.

Significantly, the incorporation of the Fresnel lens 22 into the cover 18, enhances, rather than detracts from, the appearance of the container and the average consumer will probably not recognize it as a lens, thinking it to be an item of cover decoration.

To ensure proper registration of the lens 22 with the ingredient information 20 on cylinder 14, an aligning key 24 (FIG. 3) may be provided on the inner surface of cover 18. When the cover is in the closed condition of FIG. 2, the aligning key is received within an axial slot 26 formed at the upper end of tube 14 (FIG. 1).

Figure 4:
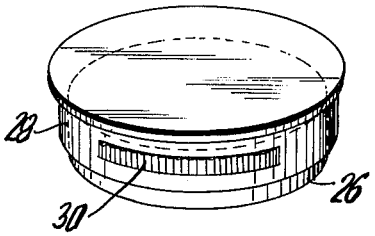
FIG. 4 is an elevation of a cosmetic container of the invention illustrating an alternate arrangement of the lens.

FIG. 4 illustrates a cosmetic container of the invention in the form of a compact in which the lower section 26 has the ingredient information printed thereon in normally unreadable small print. The overlying cover 28 of the compact includes a Fresnel lens 30 which, when the container is closed, as in FIG. 4, is in registry with and magnifies the small print list of ingredients on the lower section 26.

Figure 5:
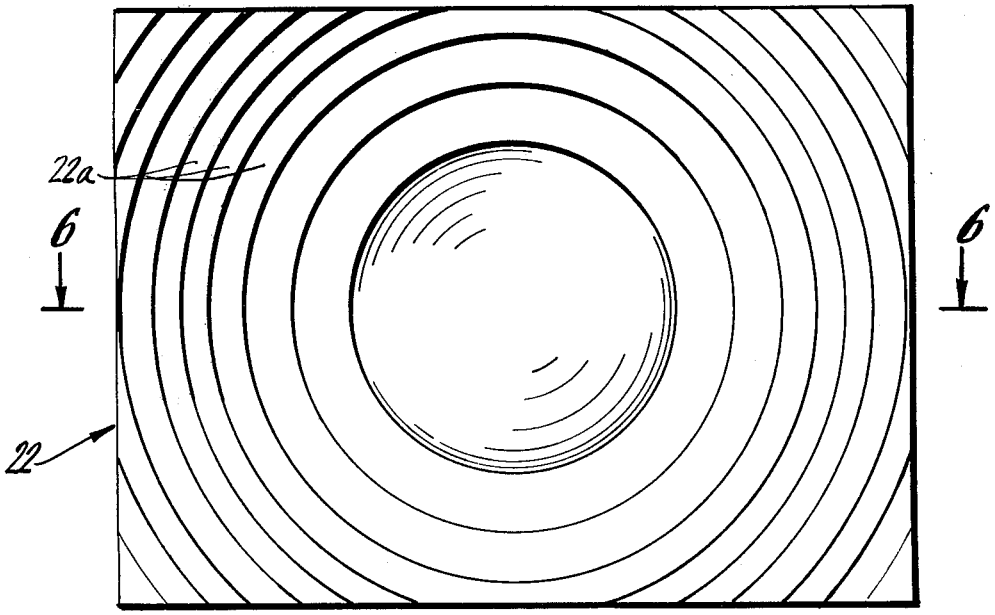
FIG. 5 is a plan view, on an enlarged scale, of a Fresnel lens of the type that may be used in the container of the invention.
Figure 6:
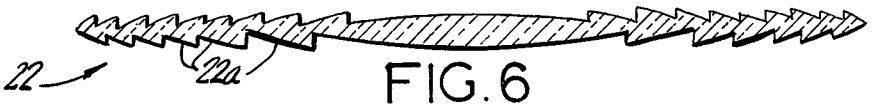
FIG. 6 is a vertical cross section of the Fresnel lens as taken across the lines 6—6 of FIG. 5.

A Fresnel lens is a lens that, as shown in FIGS. 5 and 6, typically has a surface consisting of a concentric series of simple lens sections 22*a,* so that a thin lens with a short focal length and large diameter is possible. By means of a series of precisely spaced, prismatic grooves, each at a different angle and a different depth, a flat surface lens with the optical characteristics of a curved lens surface may be produced. By the use of a clear durable plastic, such as polyethylene and by modern molding techniques, it is possible to create a low-cost plastic Fresnel lens plate having predetermined optical characteristics such as magnification properties, comparable to those obtained with conventional thicker concave or convex lenses or combinations thereof.

If the cover 18 or 28 is made of a metal, the thin plastic Fresnel lens 22 or 30 may be snapped into a slot formed in the cover in a manner to securely retain the lens in the cover. When a plastic material is used for the cover, the Fresnel lens may be molded in place as part of the cover. In either case, the lens forms part of the cover and because it is thin, the lens becomes an alternative part of the cover design, and, as noted, enhances rather than detracts from the appearance of the cover.

Thus, the container of the invention is particularly advantageous for use in a container in which, because of small size and aesthetic considerations, indicia is printed in small print, since it enables the indicia to be readily read by the consumer in a way which retains the desired attractiveness of the container. Although, as noted, above, the invention has been described for use in a lipstick container and a compact, it may be used to equal advantage in other containers having comparable size limitations and aesthetic considerations.

Moreover, it should also be understood that whereas the Fresnel lens has been described in the embodiments illustrated as being rectangular in shape, the lens can be formed to any desired shape to correspond to the pattern of the ingredient information lettering and to the shape of the cover, as well as to provide a desired appearance. Further, although the Fresnel lens is shown in FIGS. 5 and 6 as having symmetrical top and bottom surfaces, it is also within the scope of the invention to have the bottom surface of the lens different than the upper surface. In addition, in some applications, a spherical lens may be combined with the Fresnel lens.

It will thus be appreciated that although the invention has been specifically described with respect to certain embodiments thereof, modifications and variations may be made therein, all without necessarily departing from the spirit and scope of the invention.

What is claimed is:

1. A cosmetic container comprising a first member adapted to contain a cosmetic material therein and carrying on an external surface thereof indicia descriptive of said cosmetic material, said indicia being of a relatively small size that is difficult to read with the naked eye, a second cover member placed in overlying relationship with said first member when said container is in a closed condition, said second member including a thin Fresnel lens magnifying element integrally formed as part thereof and conforming in shape to at least a portion of said cover member and thereby constituting a part of the overall aesthetic appearance of said cover member, said Fresnel lens overlying and being in registration with said indicia, such that said Fresnel lens is effective to magnify said small-size indicia on said first member to an apparent size that can be read when the container is in its said closed condition.

2. The container of claim 1, comprising cooperating means on said first and second members for properly aligning said magnifying element and said indicia when the container is in its said closed condition.

* * * * *